United States Patent [19]

Foster

[11] 4,261,750

[45] Apr. 14, 1981

[54] IMPROVED EXOTHERMIC ANTI-PIPING COMPOSITION

[75] Inventor: John T. Foster, Pittsburgh, Pa.

[73] Assignee: Pittsburgh Metals Purifying Company, Pittsburgh, Pa.

[21] Appl. No.: 134,102

[22] Filed: Mar. 26, 1980

[51] Int. Cl.[3] ..... B28B 7/36

[52] U.S. Cl. ..... 106/38.28; 75/96; 106/38.27; 106/65; 106/69; 249/197; 249/202

[58] Field of Search ..... 106/38.22, 38.28, 38.27, 106/65, 69; 75/96; 249/197, 202

[56] References Cited

U.S. PATENT DOCUMENTS

| | | | |
|---|---|---|---|
| 3,308,514 | 3/1967 | Osborn | 164/123 |
| 3,804,642 | 4/1974 | Rumbold et al. | 106/38.27 |
| 3,811,898 | 5/1974 | Rumbold et al. | 106/38.28 |
| 3,923,526 | 12/1975 | Taskashima | 106/38.22 |
| 3,975,200 | 8/1976 | Takashima | 106/38.22 |

*Primary Examiner*—Lorenzo B. Hayes

[57] ABSTRACT

An exothermic anti-piping composition of the type which is formed of a refractory heat-insulating material, an exothermic compound, and an expanding media, and wherein the expanding media is predominantly either vermiculite ore or perlite ore along with less than 1% by weight of acid-treated graphite flakes.

5 Claims, No Drawings

IMPROVED EXOTHERMIC ANTI-PIPING COMPOSITION

BACKGROUND OF THE INVENTION

This invention relates to exothermic anti-piping compositions for use in the casting of molten metal to form ingots or castings. During such operations, just after pouring, it is necessary to maintain the upper portion of the molten metal at as nearly the same temperature as the molten metal in the lower layers as possible. This prevents the forming of undesirable pipe on the surface of the metal by keeping the upper portion of the metal in the molten style by preventing loss of heat therefrom.

One of the ways to prevent such heat loss is by the placing of a powder, granular, or other particulate composition on the exposed molten metal surface, which composition ignites due to the temperature of the molten metal. The composition burns and expands to leave a layer of a heat-insulating residue. This type of composition is referred to as an exothermic anti-piping composition.

Anti-piping or hot topping compositions have been used for several years, and generally include as the basic expanding media acid treated graphite flakes. An example of a hot topping composition utilizing acid-treated graphite is discussed in the Osborn et al U.S. Pat. No. 3,308,514, which utilizes 100% acid-treated graphite flakes as the anti-piping composition. The hot topping taught by the Osborne et al patent, however, is not exothermic, i.e. does not ignite itself and burn, returning heat to the ingot.

Compositions in which the amount of expensive acid-treated graphite has been reduced and replaced by another type of refractory heat-insulating material, and which are exothermic, are discussed in the Rumbold et al U.S. Pat. Nos. 3,804,642 and 3,811,898. While the amount of acid-treated graphite flakes has been reduced, it remains the primary expanding media in such hot topping compositions. In this respect the Rumbold et al U.S. Pat. No. 3,804,642 suggests using 1–50% by weight (preferably 3–20%) of acid-treated graphite and 10–50% by weight of an exothermic component such as aluminum and the like combined with a refractory heat-insulating material.

SUMMARY OF THE PRESENT INVENTION

In contradistinction, the hot topping or anti-piping composition according to the present invention replaces the large amounts of acid-treated graphite with less expensive vermiculite ore or perlite ore. Some small amount of acid-treated graphite is necessary (on the order of 0.1–0.95%) to minimize melting of some of the fillers used in the composition. Therefore, in general, the anti-piping composition according to the present invention includes a refractory, heat-insulating material; an exothermic component; and an expanding media composed chiefly of vermiculite ore or perlite ore combined with a small amount (less than 1% by weight) of acid-treated graphite flakes.

Such hot topping composition ignites soon after it is placed on the molten ingot and quickly expands to provide a thick, heat-insulating, refractory layer which acts to even better insulate and protect the surface of the ingot or casting from heat loss therethrough than with other known anti-piping compositions. This results in an ingot of higher quality, i.e. a higher percentage of sound metal.

Turning now to the basic formula for the composition according to the present invention, there is listed on the attached Table I each component and the ranges by weight which are contemplated.

TABLE I

| TYPE OF AGENT | MATERIAL | PERCENTAGE BY WEIGHT |
|---|---|---|
| Expanding Agent | Acid Treated Flaked Graphite | .1% to .95% |
| Expanding Agent | Vermiculite/Perlite Ore | 12.0% to 40.0% |
| Exothermic Component | Aluminum (Finely Divided) or its substitutes, Silicon, Magnesium, Ferro Silicon, & Calcium Silicide | 5.0% to 35.0% |
| Exothermic Component | Carbon Based Fuel (Coke Breeze) | 0% to 25.0% |
| Exothermic Component | Oxidizing Agents such as Sodium Chlorate, Sodium Nitrate, Barium Nitrate and Iron Oxide | 0% to 15.0% |
| Filler | Expanded Vermiculite/Perlite | 4.0% to 10.0% |
| Refractory Heat-Insulating Material | Alumina, Bauxite, Clay, Silicates | 26.0% to 60.0% |
| Filler | Wood Flour | 0% to 10.0% |
| Fluxes | Flourspar or Cryolite | 0% to 10.0% |

The anti-piping composition defined herein-above is preferably in powder form but may be granulated. In using this composition, the composition ignites and expands to provide a thick, heat-insulative layer which acts to reduce the heat loss from the surface of the ingot or casting. This heat-insulative layer expands between 70% and 90% of its original thickness. This expanded cover is very soft and flowable and tends to provide for refill capabilities of any voids or cracks caused by movement of the ingot prior to solidification. The composition is suitable for both foundry and steel works, and can be used on a wide variety of metals both ferrous and non-ferrous.

The quantity used of this composition is usually 50–67% of commonly used non-expandable exothermic compositions. This lower applied mass results in less heat being removed from the ingot during use.

The following specific example will serve to illustrate the invention:

Example

| Material | Units |
|---|---|
| Fine Aluminum | 7.5 |
| Aluminum | 70.0 |
| Vermiculite | 25.0 |
| Flourspar | 12.0 |

Example-continued

| Material | Units |
|---|---|
| Acid Treated Graphite Flake | 2.0 |
| Vermiculite Ore | 30.0 |
| Bag House Fines (Alumina) | 66.5 |
| Iron Oxide | 20.0 |
| Wood Flour | 15.0 |
| Sodium Chlorate | 2.0 |
| | 250.0 Units |

Four samples of the above composition were compared with two samples of a composition within the scope of the Rumbold et al U.S. Pat. No. 3,804,642. The four samples of the present invention were made in accordance with the chart hereinabove, while the two samples of the compared composition each include 8% to 10% acid-treated graphite. The samples were tested by subjecting them to the Ametek test, in which test samples of the composition are placed on a 23 centimeter square hot plate maintained at 1420° centigrade. A transient heat flow calorimeter is then utilized to compare the cumulative or net heat transfer from the plate to the atmosphere through the composition at various time intervals after igniting of the composition. Before listing the results of the test, various definitions of terms used in tabular headings of the table below should be discussed.

First, "peak heat loss" as measured by the calorimeter is the amount of B.T.U.'s initially given off to the atmosphere before the anti-piping compound begins to burn and solidify which initiates the insulating and sealing function.

The term "maximum heat output" is the heat which is transferred back into the metal ingot (steel plate in the test) as a result of the exothermic action of the compound. In other words, it is a negative heat loss, or a heat gain for the plate or ingot during actual use.

The "heat tranfer rate" is indicative of the heat insulating capability of the hot topping composition. It is the rate at which heat escapes through the topping, and is actually the slope of the line obtained by connecting points on a graph obtained by plotting net heat transfer values versus time.

Obviously of particular importance is the comparison of the heat transfer rate which is indicative of the insulative capacity of the composition. Also a maximum heat output comparison is important because it further is indicative of the effectiveness of the topping compound. In this respect, the larger the negative number, the more favorable the composition. As can be seen, the four samples of the composition of this invention average −756 B.T.U.'s per sample which are given back to the ingot, while the compound of the prior art samples gives back only an average of about 110 B.T.U.'s. Further, comparing the heat transfer rate in B.T.U.'s/feet$^2$/minute, comparison of the data shows that the present invention transfers heat at a rate of 43 to 45 B.T.U.'s/feet$^2$/minute while the composition of the prior art transfers heat at a rate of 60–65 B.T.U.'s/feet$^2$/minute. Therefore, the heat transfer rate or rate of heat loss of the present invention is only about 65% of that of the best known prior art topping compound, indicating superior performance.

Reproduced below is a chart which represents the results of the tests comparing the four samples of the composition according to the present invention with the two samples of the prior art compound. Samples 1–4 represent four separate samples of a composition made in accordance with the present invention as set forth in the example above. Samples 5 and 6 were of a kind purchased from the owner of the Rumbold et al U.S. Pat. No. 3,804,642, and are presumably of the type of compound described therein.

| SAMPLE | PEAK HEAT LOSS BTU/FT$^2$ | MAX. HEAT OUTPUT BTU/FT$^2$ | HEAT TRANS. RATE BTU/FT$^2$/MIN. |
|---|---|---|---|
| 1 | 513 | −756 | 45 |
| 2 | 612 | −592 | 43 |
| 3 | 614 | −648 | 43 |
| 4 | 432 | −997 | 44 |
| 5 | <700 | −100 | 60-65 |
| 6 | <700 | −119 | 60-65 |

It should therefore be apparent that a composition has been developed which is not only more economical, but also exhibits superior results to those obtained from the prior art compositions.

While a preferred example of the present invention has been discussed in detail hereinabove, it is apparent that the specific amounts of each component used may vary somewhat without departing from the scope of the invention, it being understood that the object thereof is to minimize the use of acid-treated graphite flakes to a value of less than 1% by weight by replacing the graphite flakes with vermiculite ore or perlite ore while not sacrificing efficiency of the composition at all. To the contrary, the composition according to the present invention exhibits superior results to results obtained by prior art compositions.

What is claimed is:

1. An exothermic anti-piping composition comprising:

(a) a refractory heat-insulating material selected from the group consisting of alumina, bauxite and silicates;

(b) an exothermic component comprising a material selected from the group consisting of finely divided aluminum, magnesium, silicon, ferro silicon, and calcium silicide and an oxidizing agent therefor;

(c) an expanding media including a major portion of at least one expandable ore selected from the group consisting of vermiculite ore and perlite ore, combined with 0.1–0.95% by weight of acid-treated graphite flakes.

2. The composition according to claim 1 wherein the refractory heat insulating material comprises 26–60 percent by weight of the composition.

3. The composition according to claim 1 wherein the oxidizing agent is selected from the group consisting of sodium chlorate, sodium nitrate, barium nitrate, and iron oxide.

4. The composition according to claim 1 wherein said expandable ore comprises 12–40 percent by weight of the composition.

5. The composition according to claim 1 comprising by weight:

| Material | Units |
|---|---|
| Fine Aluminum | 7.5 |
| Aluminum | 70.0 |
| Vermiculite | 25.0 |
| Flourspar | 12.0 |
| Acid Treated Graphite Flake | 2.0 |
| Vermiculite Ore | 30.0 |
| Alumina | 66.5 |
| Iron Oxide | 20.0 |
| Wood Flour | 15.0 |
| Sodium Chlorate | 2.0 |
| | 250.0 Units |

* * * * *